US010034533B1

(12) United States Patent
Santana-Zaizar

(10) Patent No.: US 10,034,533 B1
(45) Date of Patent: Jul. 31, 2018

(54) BACKPACK SYSTEM

(71) Applicant: Jose Luis Santana-Zaizar, Montebello, CA (US)

(72) Inventor: Jose Luis Santana-Zaizar, Montebello, CA (US)

( * ) Notice: Subject to any disclaimer, the term of this patent is extended or adjusted under 35 U.S.C. 154(b) by 0 days.

(21) Appl. No.: 15/256,506

(22) Filed: Sep. 2, 2016

Related U.S. Application Data

(60) Provisional application No. 62/214,896, filed on Sep. 4, 2015.

(51) Int. Cl.
*A45F 3/04* (2006.01)
*A45F 3/10* (2006.01)

(52) U.S. Cl.
CPC ..... *A45F 3/047* (2013.01); *A45F 3/10* (2013.01); *A45F 2003/045* (2013.01)

(58) Field of Classification Search
CPC .... A45F 3/04; A45F 3/12; A45F 3/042; A45F 3/06; A45F 3/08; A45F 3/047; A45F 2003/04; A45F 2003/16
USPC ..... 224/628, 627, 262–264, 907
See application file for complete search history.

(56) References Cited

U.S. PATENT DOCUMENTS 421,519 A * 2/1890 Rosenstock ..... A41F 9/002 2/300
D106,869 S * 11/1937 Miller ..... 224/259
2,643,803 A * 6/1953 Bates ..... A45F 5/00 119/857
2,943,775 A * 7/1960 Mack ..... A62B 9/04 224/628
3,649,921 A 3/1972 Thomas
4,013,201 A 3/1977 Potter
4,553,633 A * 11/1985 Armstrong ..... A62B 35/0037 119/857
5,131,576 A * 7/1992 Turnipseed ..... A45F 3/08 224/262
5,230,451 A * 7/1993 Onozawa ..... A45F 3/14 2/300
5,240,159 A * 8/1993 Gregory ..... A45F 3/04 224/264
D342,348 S * 12/1993 Panarelli ..... D29/101.1
5,464,137 A * 11/1995 Shirdavani ..... A41F 9/002 2/45
5,774,899 A * 7/1998 Griffin ..... A41F 3/00 2/102

(Continued)

*Primary Examiner* — Brian D Nash
(74) *Attorney, Agent, or Firm* — James F. Kirk

(57) ABSTRACT

A heavy-duty, modular backpack system or personal load bearing system replaces shoulder straps with a lightweight, SRC (semi-rigid core) and hanger suspension system, that subjects the chest or center of the body to a compressive force to transfer the load forward while freeing up the shoulders. The SRC is provided that is made out of a semi-rigid plastic such as ABS plastic or a carbon fiber composite or any other non-compressible material with similar structural characteristics. Left and right hooks pass over, forward and downward over the chest and are joined at a central coupling at a center of the human body, the "xiphoid process", a small extension of the sternum. Right and left lower straps extend to left and right lower support sites to form a arched cage on the user. A belt wraps around the waist on top of the hip bones to limit lateral movement.

11 Claims, 9 Drawing Sheets

(56) References Cited

U.S. PATENT DOCUMENTS 5,806,740 A * 9/1998 Carlson ..... A45F 3/047 224/259
6,125,475 A * 10/2000 Taylor ..... A41F 3/00 182/3
6,125,792 A * 10/2000 Gee ..... A47D 13/046 119/770
6,283,350 B1 * 9/2001 Gottmeier ..... A45F 3/04 224/627
6,626,342 B1 * 9/2003 Gleason ..... A45F 3/08 224/633
7,210,605 B2 * 5/2007 Willows ..... A41D 13/01 224/623
7,243,376 B2 * 7/2007 Johnson ..... F41H 1/02 2/102
7,353,779 B2 * 4/2008 Altieri ..... A01K 1/029 119/770
D604,380 S * 11/2009 Garcia ..... D21/804
8,424,731 B2 * 4/2013 Lifshitz ..... A47D 13/02 224/158
D687,913 S * 8/2013 Garcia ..... D21/805
8,714,424 B2 * 5/2014 Oddou ..... A45F 3/04 224/262
8,960,511 B2 * 2/2015 Shepherd ..... A45C 3/00 224/259
8,985,420 B2 * 3/2015 Dapkins, Jr. ..... A45F 3/04 224/578
9,084,470 B1 * 7/2015 Huck ..... A45F 3/14
9,113,697 B2 * 8/2015 Brensinger ..... A45F 3/04
9,462,875 B2 * 10/2016 Paduano ..... A45F 3/047
9,545,144 B2 * 1/2017 Gill ..... A45F 3/04
2003/0121942 A1 * 7/2003 Chang ..... A45F 3/14 224/260
2009/0179057 A1 * 7/2009 Basye ..... A45F 3/047 224/628
2010/0051660 A1 2/2010 Noffsinger
2014/0001221 A1 * 1/2014 McDonald ..... A45F 3/14 224/637
2014/0151424 A1 * 6/2014 Hexels ..... A45F 3/06 224/637

* cited by examiner

BACKPACK SYSTEM

Provisional Patent Application

Ser. No. 61/763,044, filed Feb. 11, 2013 Previously for a BACK PACK DEVICE

No government funds or effort were spent in the design or development of this invention.

BACKGROUND OF THE INVENTION

Field of the Invention

The present invention relates generally to the field of backpack devices. It more specifically relates to the field of heavy-duty, modular backpack systems that have an equipment-attachment portion of the apparatus positioned on a users back and, that have shoulder straps attached to the equipment-attachment portion of the apparatus that drape over the shoulders of the user to transfer the load carried in the equipment-attachment portion of the apparatus to the user's shoulders.

Description of the Related Art

The features of the earliest "backpacks" are lost in the far reaches of prehistory, the leather, plant fibers, and animal sinews of their construction long since decomposed and returned to earth. Early European explorers in North America witnessed Native Americans carrying their possessions, or the carcasses of wild game, lashed to boards which they in turn strapped to their backs with leather harnesses. The fur-trapping Voyageurs of the North, who explored the Great Lakes and Canada by canoe and portage, adopted another native packing technique—that of the "tump line," in which a pack-sack was carried not by shoulder-straps but by a padded cord or line that rested above the wearer's forehead and attached to the sides of the pack. While the shoulder straps of a backpack place the load upon the user's shoulders, the tump line transferred the load to the user's spine.

Late 19th and early 20th century woodsmen combined the shoulder-strap rucksack with the tump-line for further support in carrying heavy loads over long distances by foot. By the time of the Second World War, alpine military backpacks had acquired a tubular steel outer frame, foam rubber padding for the lower back, and a waist strap. But it was not until the 1970s and 80s that the modern, ergonomically designed backpack arrived on the scene, carried around the world on the shoulders of users.

Modern backpacks are sophisticated affairs, employing lightweight, rigid or semi-rigid internal frames and space-age synthetic fabrics to provide maximal carrying capacity and comfort. Packs are classified according to use and carrying capacity. Day-hiking packs are the smallest and lightest packs, designed for afternoon hikes and climbs, and for campus and city use. Day-hiking packs typically possess about 1,500 cubic centimeters of space. Weekend packs are designed to provide capacities of up to 3,500 cubic centimeters. Weekend packs accommodate backpacking trips that range in length from a couple of days to a month or more.

Expedition packs are the largest, with volumes of up to 6,000 cubic centimeters, and are built for long treks in the Himalaya, summers afoot in the Alps, and even the climbing of Mt. Everest. Beyond these, there are hydration packs which provide hikers and climbers with cold fluids via a flexible drinking hose. Hydration packs are; small, lightweight packs that can be worn alone, or that can be carried within a larger pack for the final, unencumbered push up to a peak or they can be carried in a fanny pack.

Despite the great variety of packs and backpacking systems, the questions are always the same: How much can a wearer of the backpack carry? And how comfortably can the wearer carry it? Unless a pack can be carried comfortably, it doesn't matter how much it might hold: Until the packer achieves comfort under his load, he's going to lighten it along the trail, item by item.

The most comfortable packs are designed to distribute the load throughout the shoulders, spine, and hips. However, even the best contemporary packs depend on straps that encumber and fatigue the shoulders, and limit the motion of the packer's shoulders and arms. All backpackers and trekkers want the most comfortable, highest-capacity pack they can carry; and some—hunters and soldiers, for example—also require the freedom of motion that would allow them to aim and fire a rifle while carrying their pack. Similarly, anglers and climbers want the freedom to fish or climb while packing. The backpack to be introduced, described, and discussed in the course of this application will meet these requirements in a way that no other packing system can match.

Various attempts have been made to solve problems found in Backpack Systems art. Among these are found in: U.S. Pat. No. 4,013,201 to Glenn James Potter; in U.S. Pat. No. 3,649,921, to David F. Thomas et al; and in U.S. Patent No. 2010/0051660 to Guy Noffsinger. These prior art references are representative of Backpack Systems.

None of the above inventions and patents, taken either singly or in combination, are seen to describe the invention as claimed. The present application teaches a reliable Backpack System with a feature that replaces the conventional shoulder straps with a lightweight, semi-rigid core that transfers the load forward toward the center of the body, freeing up the shoulders and arms and avoids the above-mentioned problems.

SUMMARY OF THE INVENTION

The Backpack System provides a solution to the aforementioned challenges. As the name implies, the Backpack System comprises a specially designed heavy-duty, system, the design of which eliminates the conventional shoulder straps and replaces the conventional shoulder straps with a lightweight, covered semi-rigid core assembly.

In one alternative embodiment, the covered semi-rigid core assembly comprises a cover having an outer and inner panel, the SRC semi-rigid core is padded by an outer and inner Styrofoam pad cut to match the outline of the semi-rigid core. The Semi-rigid core is then sandwiched between the Styrofoam pads and then sewn and sealed within the inner and outer panels to form the covered semi-rigid core assembly 12.

The SRC semi-rigid core 22 has a back plane region that is undivided, and which extends upward within the covered semi-rigid core assembly 12 on a user, to a bifurcated covered left and right portion that resembles a hook, each of which pass over the shoulders of the user. Each over the shoulder hook like portion has a distal end. The two distal ends are coupled together by a two part quick snap coupling 78. The distal ends of the bifurcated left and right over shoulder portions 32, 34 and the two part quick snap coupling 78 are then linked to respective lower rear corners of the back plane by left and right lower straps that are adjusted to be in tension when the backpack system is worn. When in tension, the left and right lower straps and the two part quick snap coupling 78 urge the covered semi-rigid core assembly 12 into the shape of a stabilized cage on the user. The covered semi-rigid core assembly 12 is fitted with shackles to which a back pack load is attached. The cage forms a substantially incompressible arch above the tops of the left and right shoulders of the user leaving the users arms free to hold objects, such as a tool or a rifle or to do work.

The features and functions and other features, aspects, and advantages of the present invention will become better understood with reference to the following drawings and the following detailed description.

DETAILED DESCRIPTION

Figure 4:
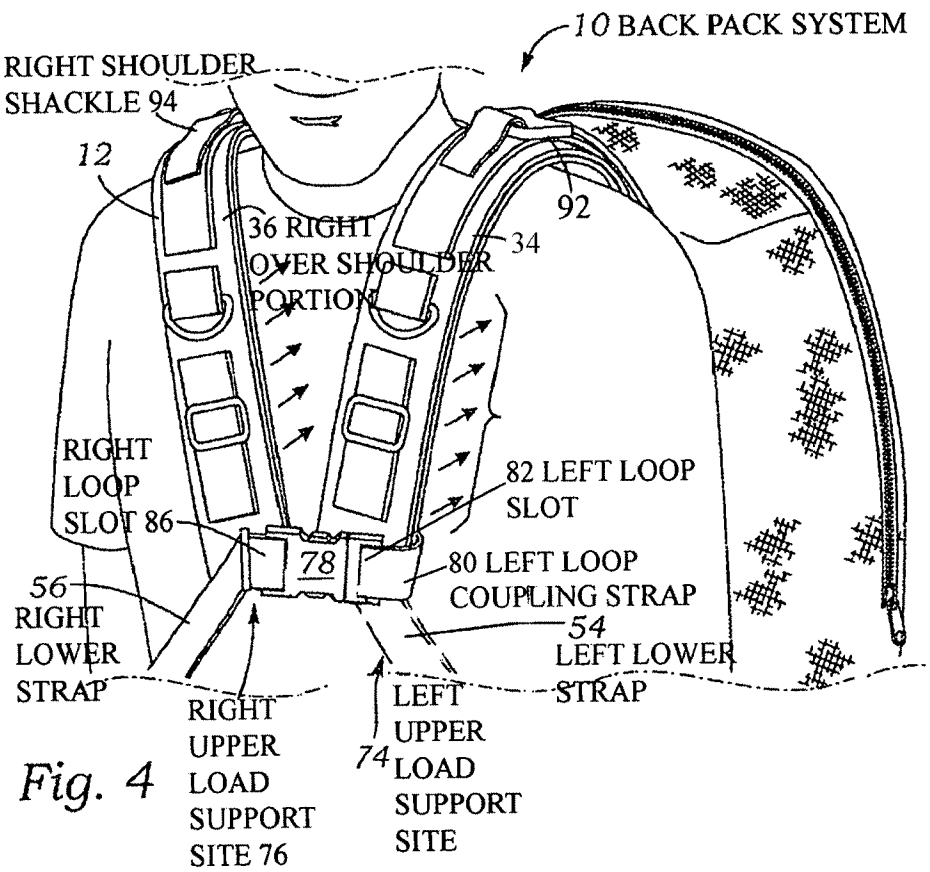
FIG. 4 is a front left perspective schematic view showing a zipper on the left edge of the SRC cover.
Figure 6:
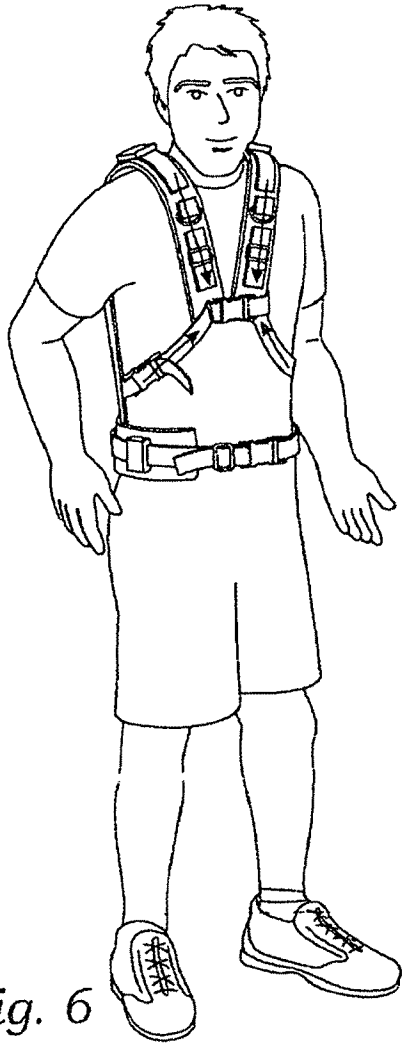
FIG. 6 is a front right perspective schematic view illustrating a wearer using the Backpack System of FIG. 5.
Figure 5:
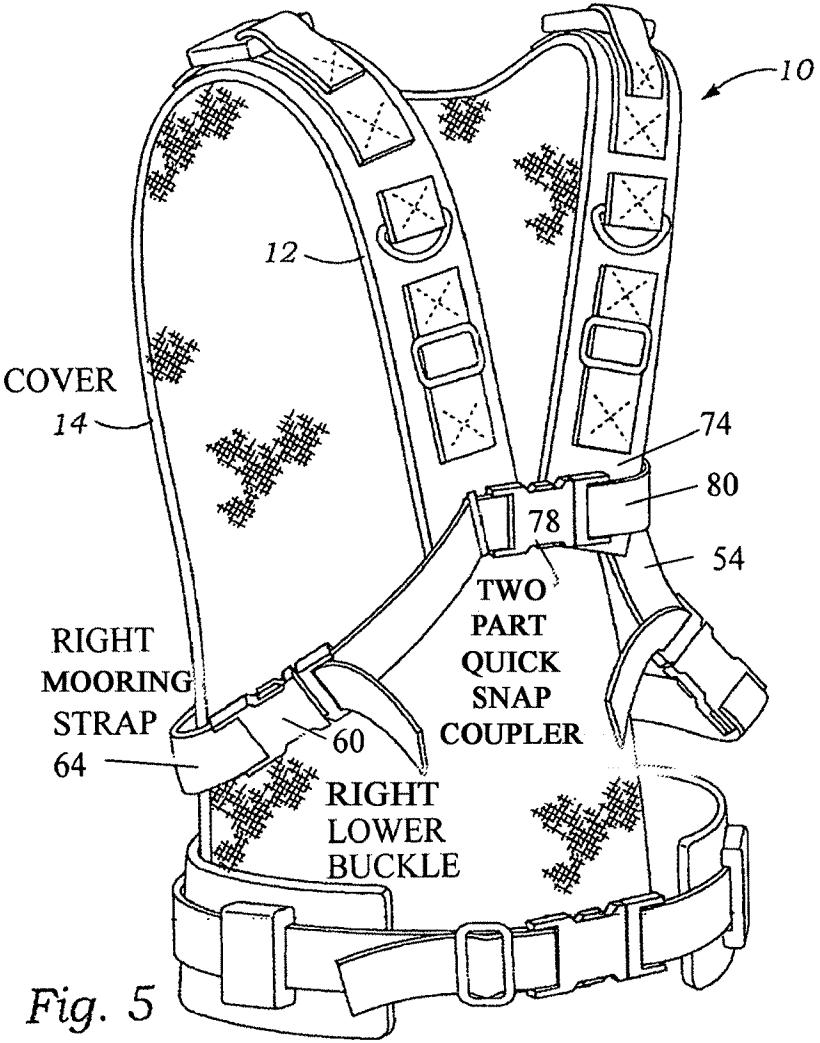
FIG. 5 is a front right perspective schematic view illustrating the Backpack System.
Figure 15:
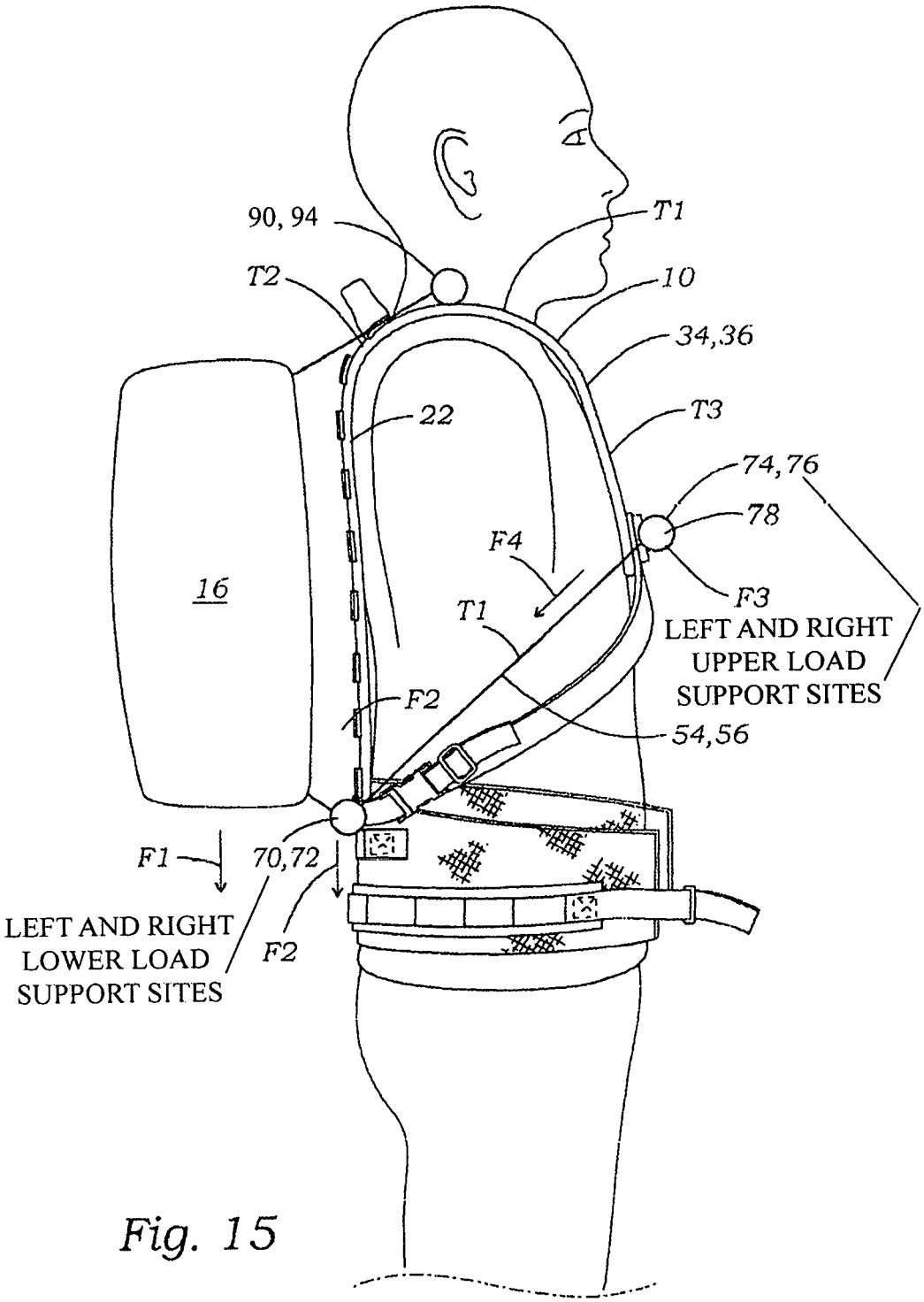
FIG. 15 is a schematic view of the right side, of the backpack system.

FIGS. 1, 2, 3, 4, 6 and 15 show the Backpack System 10 on a user. The views show a number of straps and buckles coupled to and extending from the Backpack System 10 that enable the system to support a load on the back of the user. FIG. 15 shows the Backpack System with a field pack 16 coupled to its external rear surface 17. FIG. 4 shows the cover having a zipper 18 on the left edge 20. FIG. 5 is an alternative view of the backpack 10 without a field pack 16. FIG. 6 shows the Backpack System on a user with no field pack or load attached to the Backpack System.

Figures 7, 8, 9:
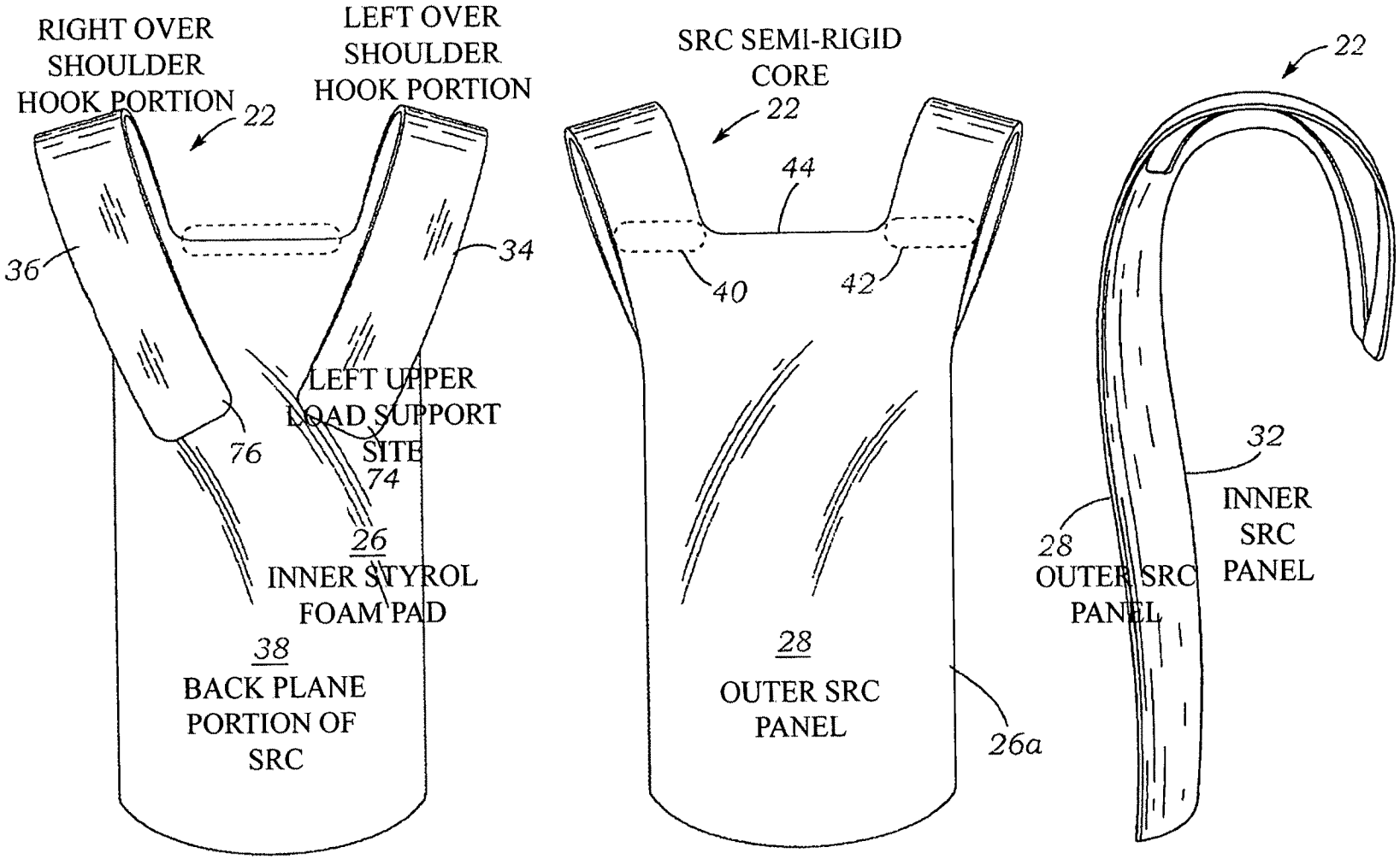
FIG. 7 is a front schematic view of the SRC (Semi-Rigid Core)
FIG. 8 is a back schematic view of the SRC (Semi-Rigid Core)
FIG. 9 is a side schematic view of the SRC.
Figure 10:
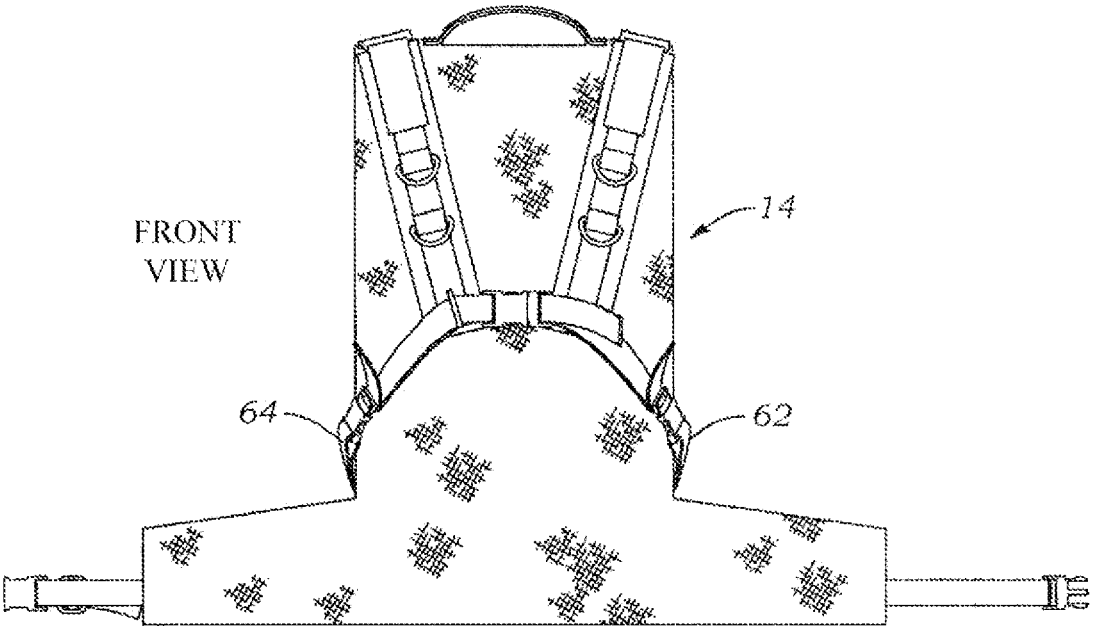
FIG. 10 is a schematic front view of the backpack cover, showing the adjustable lower waist belt and buckles, the lower left and lower right straps.
Figure 11:
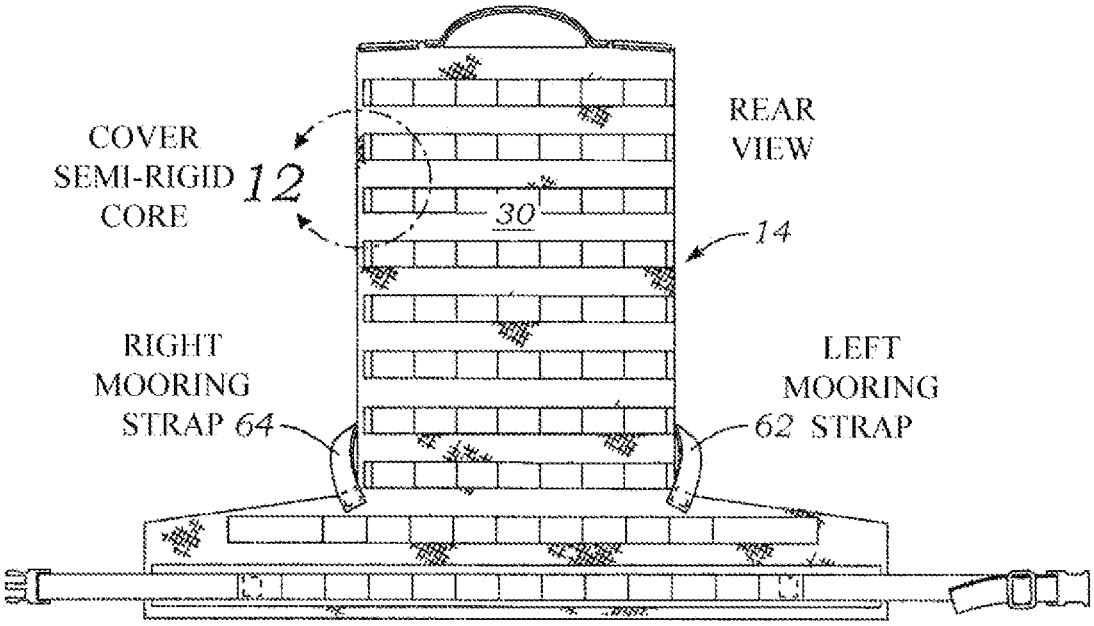
FIG. 11 is a schematic back view of the backpack cover, showing the lower waist belt and buckles and the lower left and right straps for the points of attachment, phantom circle 12 shows where the partial cross section of FIG. 12 was taken.

FIGS. 7, 8 and 9 are separate views of an SRC (a semi-rigid core) 22. FIGS. 1-5 show the Backpack System 10 with the SRC 22 inserted in a cover 14 to form a covered semi-rigid core assembly 12. The cover's front panel or surface 15*a* is shown in the plan view of FIG. 10. The rear surface of the cover 15*b* is shown in FIG. 11. Phantom circle 12 in FIG. 11 shows where the partial sectional view of FIG. 12 is taken.

The Semi-Rigid Core (the SRC)

Figure 12:
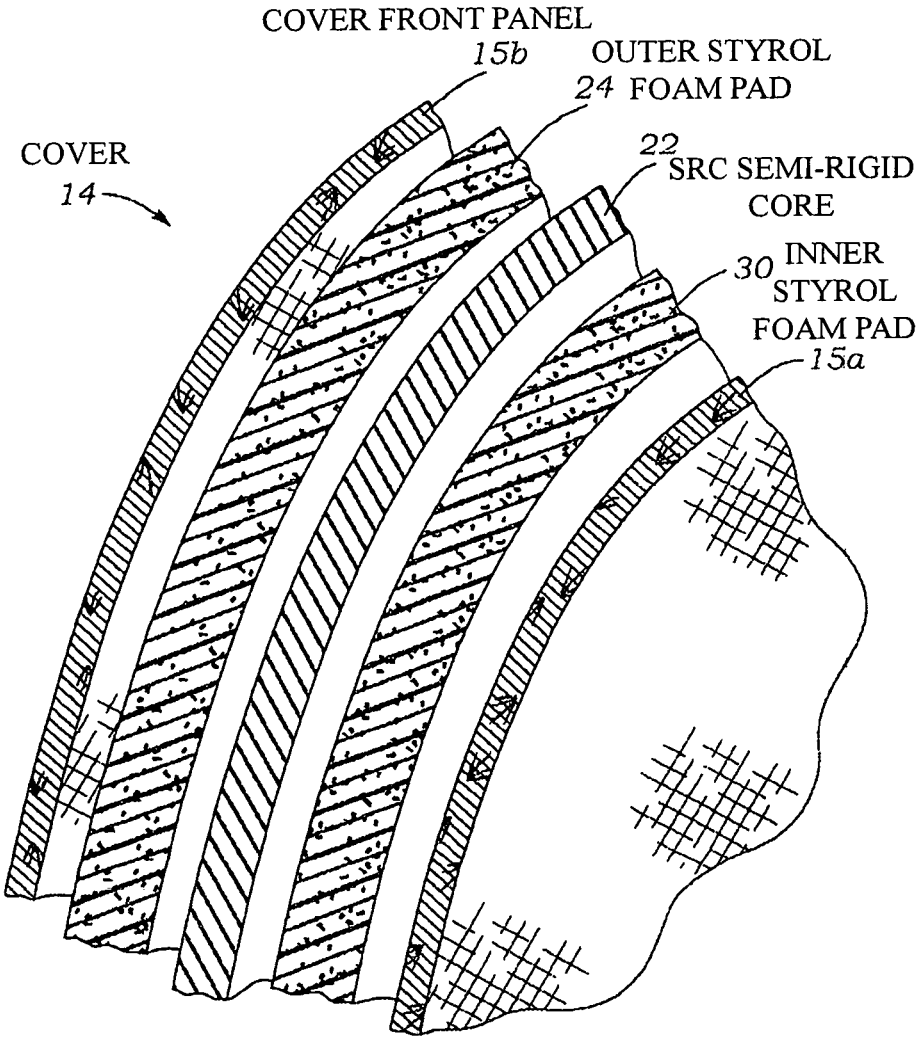
FIG. 12 is a schematic expanded partial sectional view of the phantom circle 12 region shown in FIG. 11.

The SRC 22 appears in the sectional view of FIG. 12. As shown, in FIG. 12, the SRC is sandwiched between an outer Styrofoam layer 24 and an inner Styrofoam layer 30. FIG. 11 and the partial sectional drawing of FIG. 12, show that cover 14 has cover front panel 15*a* and a cover rear panel 15*b*. The Phantom circle 12 on FIG. 11 designates a generalized region on the cover 14 at which the section of FIG. 12 might have been taken to show how the SRC 22 is contained in the composite layers in the cover 14.

Fabricating the Outer and Inner Styrofoam Pads 24 and 26

The outer and inner Styrofoam pads 24 and 30 respectively are formed from sheet Styrofoam having a thickness of 0.25 inches but can be expected to be made with the thickness of the Styrofoam sheet in the range of 0.125 to 0.375 inches. Acceptable tests have been conducted with 0.25 inch pads, the inner Styrofoam and outer Styrofoam pads being of the same thickness.

Fabricating the Cover 14

The inner SRC panel 15*a* and an outer SRC panel 15*b* are typically made from a tough, light nylon fabric. The required buckles (not shown) and belts (not shown) are located on the outer SRC panel 15*b* and then sewn onto the external surfaces of the outer SRC panel 15*b*. The edges of the outer SRC panel 15*b* are then partially joined to the edges of the inner SRC panel 15*a* to form a partially sealed cover 22 having an opening such as that provided by the zipper shown in FIG. 4. The edges can be formed by using prefabricated edging, biased edging or by other conventional methods used to join fabric panels by sewing.

The opening (not-shown) in the partially sealed cover 22 is made large enough to permit insertion of the SRC, 22 as a separate component followed by insertion of the outer Styrofoam pad 24 and an inner Styrofoam pad layer 30. In the alternative, the padding can be attached to the SRC 22 before insertion of an SRC and padding sub-assembly or the padding can be attached to inner surfaces of the panels before the inner SRC panel 15*a* and the outer SRC panel 15*b* are joined at their respective edges to form the cover 14. In the embodiment shown, the outer and inner pads 24, 30 were not pre-attached to the panels nor to the SRC 22. The outer and inner pads 24,30 and the SRC 22 were stacked and then slipped into the opening (not shown) before the partially sealed cover was completely sealed by stitching the edges of the panels to lock in the separate layers. Insertion of the SRC 22 into a position between opposing faces of the outer pad 24 and inner Styrofoam pad 30 should be completed in advance of joining the remaining edges of the outer and inner SRC panels 15*b*, 15*a* to seal the cover.

After the edges of the outer and inner SRC panels are sewn or joined by other means to create a sealed bag, the cover 14 comprising the outer and inner SRC panels 15*b*, 15*a* is slipped over the outer pad 24 and inner pads 30 forcing them tightly against opposite sides of the SRC 22 to form the composite layered structure depicted in the partial section of FIG. 12.

Clips, buckles and straps are added to the outer cover as needed to support the attachment of appliances such as a field pack 16, a carrying case or tools related to the ultimate use of the integrated Backpack System 10 by a user tasked with carrying a load.

The clips, buckles, belts and other appliances required on the outer and inner panels are located on and sewn to the outer panel of the cover with jigs or with pre-printed sites on the outer panel. The clips, buckles and belts are then fixed to the assembly by sewing the required clips, buckle or belt features to the panel before the outer and inner panels are partially joined. The stitching of the features at the points of attachment is completed with nylon thread. The threads that pass through the cover layers, or through the ribbing that is selected for use at the edge of the panels, but the stitches do not pass through the two foam layers or through the centrally located SRC 22.

Fabricating the SRC (Semi-Rigid Core 22)

Figure 14:
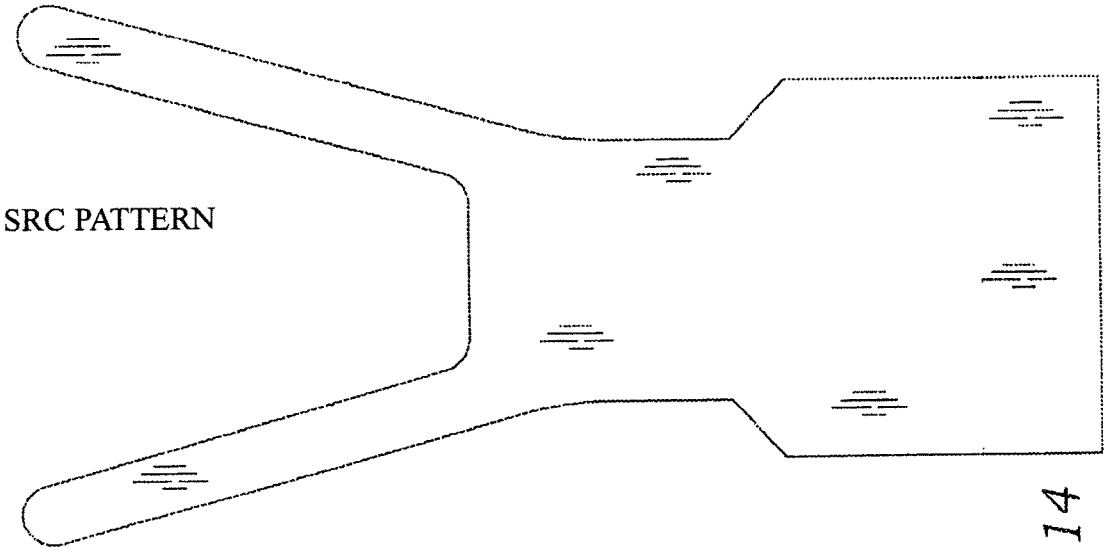
FIG. 14 is a schematic sketch of a flat pattern for the SRC before molding
Figure 13:
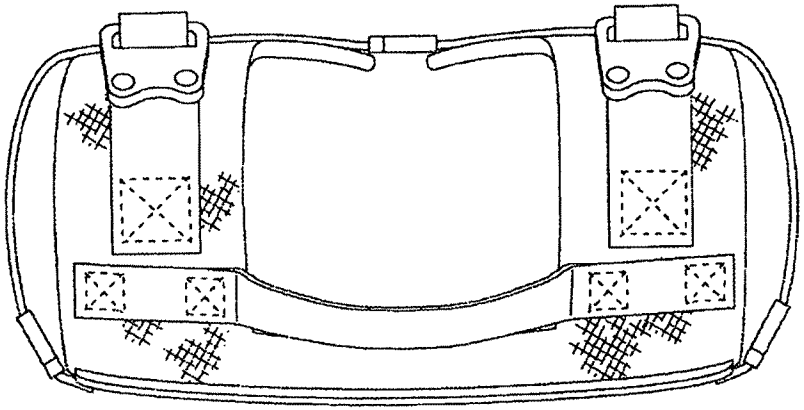
FIG. 13 is a schematic top view of the backpack system.

The SRC 22 is formed from a sheet of semi-rigid ABS plastic, and the outline of the SRC is schematically shown in the front, back and side views of FIGS. 7, 8 and 9 respectively. The process of making the SRC begins with providing a flat pattern such as that shown in FIG. 14. An SRC was formed from ABS plastic sheet having a thickness of 0.125 inches; however, it is believed that a thickness in the range of 0.125 to 0.250 will work as well, but there would be a slight weight penalty. The patterns and shapes provided in FIGS. 6, 7 and 8 are submitted to serve as a guide for use in developing a cutting pattern and form for molding with a heat or laser or knife source or with stamping dies. The use of ABS sheet in the model that was reduced to practice, but the process did not include added reinforcement or stiffening material in a uniform or regional application. However, the use of such material such as fiber glass with or in place of the ABS material is envisioned along with as high energy adsorption material such as Kevlar or soft fiber materials with an appropriate binder. Fiber material with a fire resistant binder is contemplated. Use of such material to replace or assist the Styrofoam pads can possibly lead to an improved SRC 22.

SRC Locations and Regions

Referring now to FIGS. 7, 8 and 9, the pattern of the SRC 22 component can be characterized as having regions or portions empirically arrived at from the size of the expected user. The following discussion will identify positions and regions on SRC with some particularity to assist in claiming the invention. A typical SRC 22 will have a left and a right over-shoulder portion 32, 34 and a back plane portion 38. Referring to FIGS. 7 and 8, the left and right over shoulder portions each extend from a respective left and right root portions 40, 42 that is formed from the same homogeneous sheet material coupling the left and right over shoulder 34, 36 portions to the back plane portion 38. The left and right over the shoulder hook portions are thereby enabled to transfer tensil and or compressive loads to or form the back plane portion 38 via the respective left and right root portions 40, 42.

FIGS. 7 and 8 show that the left and right root portions 40, 42 are separated by center top edge portion of the back plane 44 selected to space and position the left and right over the shoulder hook portions 34, 36 over the respective shoulder of the user.

Left and Right Lower Buckles, Lower Straps

Figure 2:
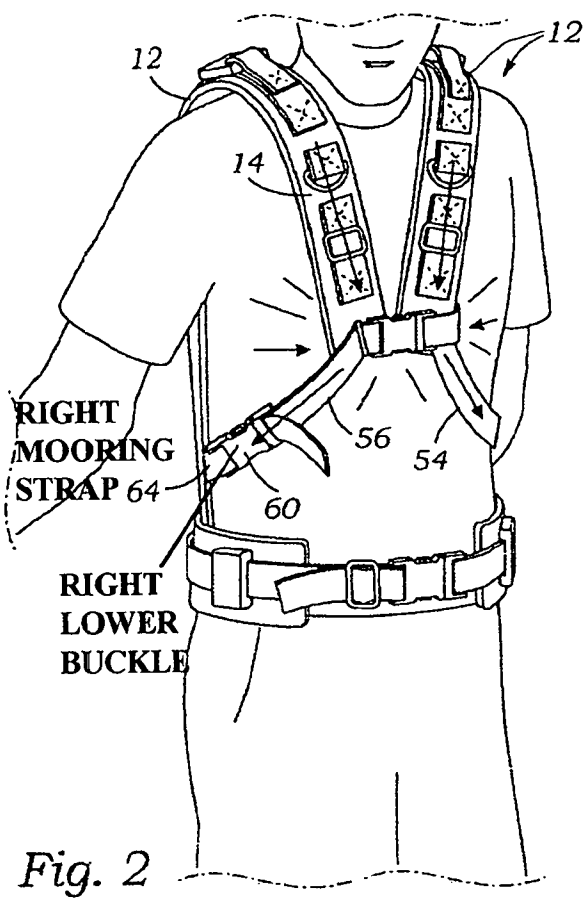
FIG. 2 is a front right perspective schematic view illustrating the Backpack System worn by a user.
Figure 1:
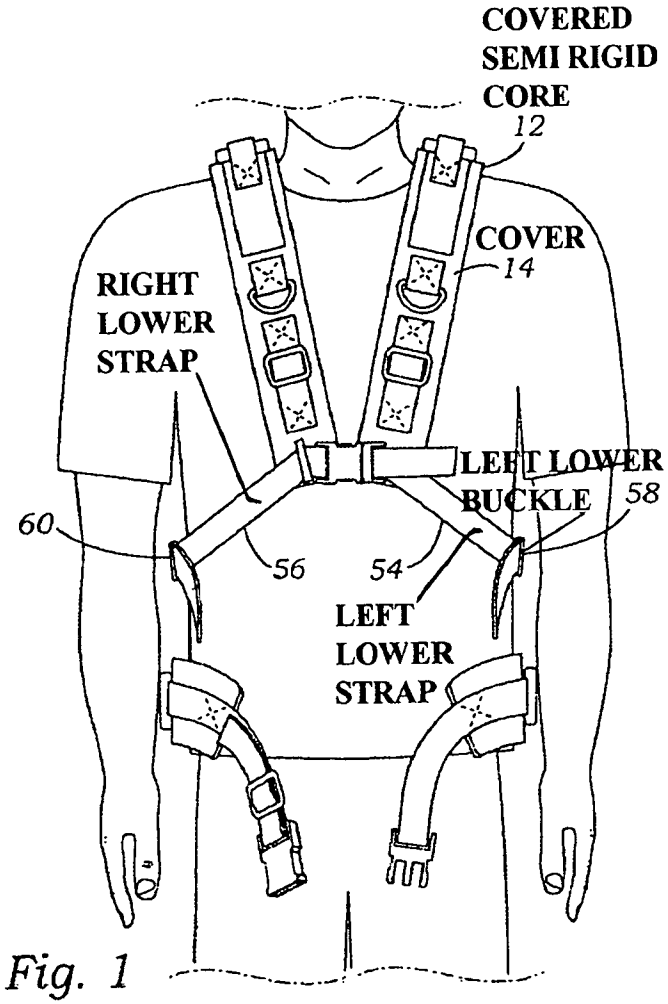
FIG. 1 is a front schematic view of the Backpack System worn by a user.
Figure 3:
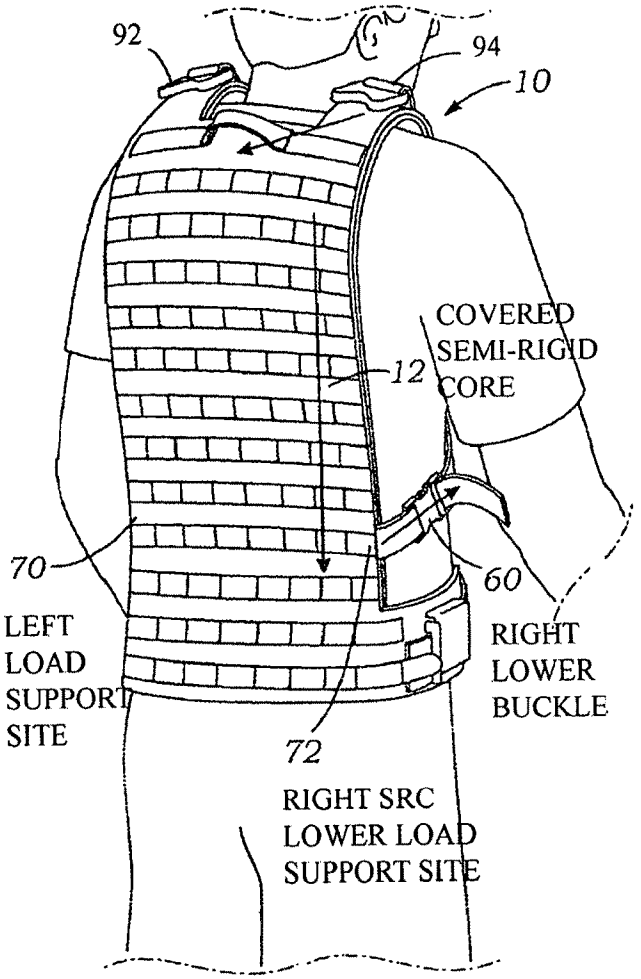
FIG. 3 is a back right perspective schematic view illustrating the back cover of the Backpack System worn by a user.

FIG. 1 shows the location of a left and right lower buckle 58, 60. FIGS. 2, 3 and 5 show the location of the right buckle 60. FIG. 10 shows the location of a short pigtail straps, a left mooring strap 62 and a right mooring strap 64 leading to respective left and right buckles. The straps are attached to the outer SRC panel 15*b* and are terminated at respective buckles to form or establish respective lower left and right points of attachment for the respective left and right lower straps 54, 56 shown in FIG. 2. FIG. 3 and FIG. 11 show the location of the right lower buckle 60. The left and right lower buckles 58, 60 should be positioned on the outer SRC panel to position them to be at a location one to two inches above the top edge of the user's hip bone. With this location established, the length of the SRC and the shape of the left and right over shoulder hook portions 34, 36 should be adjusted in size to position the inside surface of the hook to be above and totally free of the top of the user's shoulder with a fully loaded, (40-120 lbs) field pack 16 attached to the top region of outer or back SRC panel 15*b* of the cover 14 of the back pack suspension system as shown in FIG. 15.

FIGS. 4 and 5 show the location of the left and right lower straps 54, 56 with the lower end of the straps adjustably gripped by the left and right lower buckles 58, 60 respectively. Each of the lower buckles have a mooring slot which receives a mooring strap. FIG. 3 shows the right lower buckle 60. A right lower buckle mooring slot 66 is shown at the lower right side of the right mooring buckle. Each side of the cover has a lower right mooring strap that is passed through a respective lower buckle mooring slot. FIG. 3 shows the right lower mooring strap 68 passing through the right lower buckle mooring slot 66. After passing through the right lower buckle mooring slot 66, the left and right mooring straps 62, 64 are sewn to the cover to form a loop to hold the respective left and right lower buckle 58, 60 firmly on the cover 14 at a respective SRC load support site. FIG. 3 and FIG. 15 shows the approximate location of the left and right SRC lower load support sites 70, 72 on the outer cover 14.

Cross Strap (Coupling)

The left and right over shoulder hook portions 32, 34 of the SRC 22 are also inserted into the cover 14 and padded with respective outer and inner Styrofoam pads. FIG. 4, 15 shows the approximate location of the distal end of the left and right over shoulder hook portions 34, 36 of the left and right upper load support sites 74, 76 on the cover after the respective portions are covered and padded.

FIG. 4 is a sketch that shows the covered distal ends of the left and right over shoulder SRC hook portions 32, 34. A two part quick snap coupling 78 is shown in the coupled mode.

Referring now to FIG. 4, the upper end of the left lower strap 54 is visible. One end of a short (2-4 inch) left loop coupling strap 80 passes through a left loop slot 82 on the left side of the quick snap coupling 78. Both ends of the short loop coupling strap are then placed under the top end of the left lower end strap 54 and the composite stack of ends is sewn onto the outer SRC cover panel 15*b* and form the left upper load support site 74 at the left distal end of the left over shoulder hook portion of the Backpack System 10 on the outer SRC cover panel 15*b*.

In a similar fashion, the upper end of the right lower strap 56 is visible. One end of a short (2-4 inch) right loop coupling strap 82 passes through a right loop slot 86 on the right side of the quick snap coupling 78. Both ends of the right loop coupling strap 82 are then placed under the top end of the right lower end strap 56 and the composite stack of ends is sewn onto the outer SRC cover panel 15*b* and form the right upper load support site 74 at the right distal end of the right over shoulder hook portion of the Backpack System 10 on the outer SRC cover panel 15*b*.

Left and Right Over the Shoulder Hook Portions

The width, length, and thickness of the left and right over shoulder hook portions 34, 36 of the SRC are empirically designed to function as an arch that is simply supported from a region on the users back below the neck and behind the top of the shoulders of the user. FIGS. 3 and 4 show left and right shoulder shackles 88, 90 coupled to the outer SRC cover panel 15*b* on the left and right over the shoulder hook portions 34, 36. In operation, the field pack 16 shown in FIG. 15 has a left and right shackle at the end of short left and right short belts that couple to respective left and right shoulder shackles 88, 90 and thereby transfer the weight and load of the field pack to the respective left and right over shoulder hook portions 34, 36 of the SRC and more particularly to the outer SRC panel material covering the over shoulder hook portions 34, 36.

Figure 16:
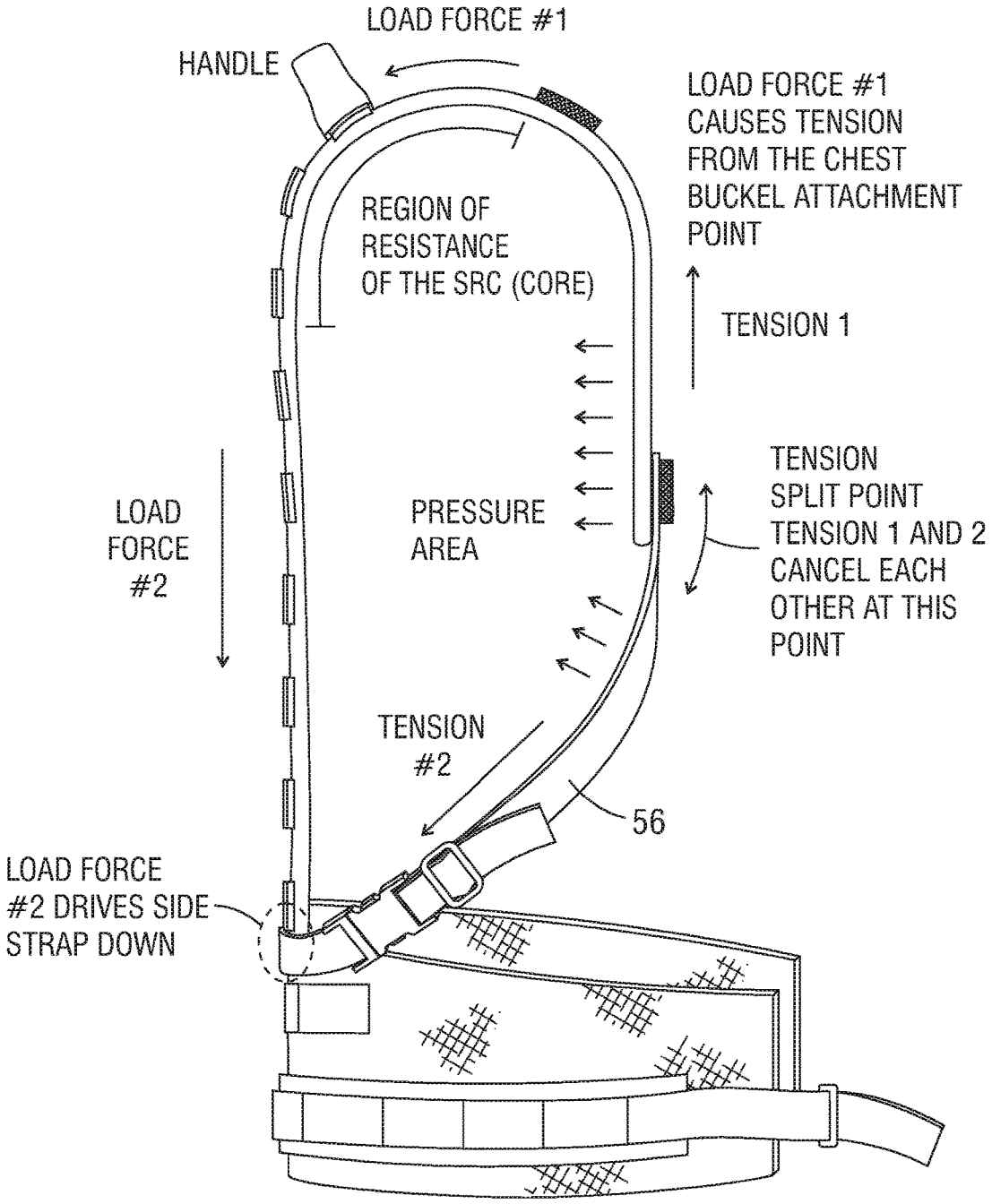
FIG. 16 is a schematic view of the right side, of the backpack system, showing the tension load in the right lower strap, a tension load in the SRC right shoulder hook portion of the SRC, the right lower strap clamping the cross strap to the user's chest.

FIG. 16 is a side elevation schematic sketch that provides a diagram of forces applied to the Backpack System 10 by a field pack 16 such as shown in FIG. 15. The drawing shows a curved vector belt that extends from the top right corner of a block representing a shackle over the crest of the SRC. This vector is intended to represent a tension load produced by Load Force #2 from the back pack load provides Vector F2, a force that represents a weight carried in field pack 16. The drawing is planar, but the nodes are arranged in symmetrical pairs on the left and right side of the user. The left and right shoulder shackles 88, 90 are shown at the top or crest of the left and right over shoulder hook portions 34, 36 of the Backpack System 10. The bottom right corner of the block representing the field pack 16 is connected by a short strap to the left and right lower load support sites 70, 72 shown in FIG. 3. The left and right over shoulder hook portions 34, 36 of the covered SRC 22 are shown extending over the shoulder, free of the top surface of the shoulder, and terminating at a point of interception of F2 with Tension 2 and where the force F2 is opposed by Tension 2. FIG. 15 shows the left and right upper load support site 74, 76 that is being held against the chest of the user. The left and right lower straps 54, 56 are represented by a single line that is in tension cancelling the left and right SRC lower load support sites 70, 72 by transferring the downward force of F1 to the left and right upper load support sites 74, 76. The left and right lower straps 54, 56 are in tension and the arrangement drives the covered SRC semi-rigid core into an arch. The sketch of FIGS. 15 and 16 show that the arch formed by the left and right over shoulder hook portions 34, 36 operate to form a forward pair of mooring pads at the site 74, 76 and a rear set of mooring pads a the left and right lower load support sites 70, 72 with the load of F1 transferred to the circle representing the left and right shoulder shackles 88, 90 at the crest of the left and right over shoulder hook portions 34, 36. The arched form of the over shoulder hook portions 34, 36 enable the shape to support the load at the crest as the left and right portions of the crest go into tension without collapsing as the load from F1 is transferred to the left and right shoulder shackles 88, 90. As the left and right over shoulder hook portions press down, the load is transferred to the chest at the F3 and to the back above the hips at 70, 72. The load is applied to the left and right over shoulder hook portions 34, 36 at the left and right shoulder shackles 88, 90 respectively, free of contact with the top of the user's shoulders. The tension in the left and right lower straps 54, 56, and the surface friction at the chest at the left and right upper load support site 74, 76 and above the hips at the left and right lower support sites 70, 72 act in combination to divide the load F1 with friction and interference with the contours of the user's body to prevent downward vertical sliding movement of the covered SRC 22 and Backpack System 10.

As discussed above, embodiments of the present invention relate to a backpack device and more particularly to a Backpack System which eliminates the conventional shoulder straps and replaces them with a lightweight, semi-rigid core and hanger suspension system that transfers the load toward the center of the body, freeing up the shoulders The Backpack System 10 is designed to meet the needs of campers, trekkers, hunters, and military field personnel for a versatile, high-capacity, easily customizable pack, the Backpack System would offer unbeatable comfort on long-distance treks, a more efficient distribution of the load, and a wider range of arm and shoulder motion than is achievable with traditional packing systems.

The Backpack System would shown and taught is a tough and versatile, modular and customizable backpack system in which the pack is supported not by conventional shoulder straps, but instead by a unique and innovative suspension system that relies on a pair of stiff but flexible, form-fitting, molded hooks or hangers that will be closer to the body's vertebral axis than are shoulder straps, thus transferring the load toward the center of the body and freeing up the shoulders. The Backpack System can be produced by a firm or firms classified within the Sporting and Athletic Goods Industry, Standard Industrial Code 3949.

The backpack of the Backpack System is a modular design, meaning that the pack system is built up in a series of interchangeable components, or modules. This approach ensures that the system can be customized by users to meet their own specific needs. The basic outfit of the pack will consist of two modules, one a larger pack and one a smaller, detachable daypack, fanny-pack or summit-pack, each of which will fasten detachably to the core or suspension system of the pack with the integrated SRC 22. Further modules—hydration packs; chest or belly packs; accessory storage packs; cargo carriers, hooks, and snaps; rifle slings; game pouches and so forth—may be easily incorporated into the system. The entire system has been designed to provide users with the capacity to carry gear and supplies for anything from a day-hike or climb to a five-day backcountry trek. The chest area of the Backpack System would provide further anchorage and support for such accessories as GPS units, radios, maps, water bottles and energy bars, and small arms; and the Backpack System, in its military version(s), would also accommodate dedicated, strap-on or snap-on modular bulletproof panels, both front and back. The military version can eliminate the cover and mold the entire outer envelope of the equivalent covered version with couplings of buckles and shackles being accomplished with rivets.

The pack which will be supported by the core of the Backpack System could (and should, to appeal to the largest possible market) be produced in a variety of styles and capacities to suit the needs of day-hikers, weekend backpackers, and extended-trip backcountry packers and hunters. These modular packs would thus vary according to model, although standard features should include both top- and side-loading access; high-denier nylon construction with a polyurethane shell; triple-stitching throughout and bar-tacking at all stress-points; ample interior and exterior pockets and pouches; bedroll and sleeping-pad straps; strategically placed D-rings; and other features generally found in high-quality backpacks. The packs might also be produced in a variety of colors, as well as in camouflage. As the most important improvements represented by the Backpack System are to be found in the frame-and-carry system rather than in the pack itself, the reader may be assured that the pack would bear all the hallmarks and features one would expect in a premium pack such as those produced by Kelty, REI, North Face, and other outdoor manufacturers.

The Backpack System will replace the conventional core of the backpack market—a core supported primarily by shoulder straps—with a core that is supported by a pair of semi-rigid, lightweight, form-fitting "hooks" or "hangers" formed from a homogeneous material thus simplifying manufacture. The Backpack System will suspend the pack from a back plane extending homogeneously into a pair of over the shoulder hook portions positioned astride the user's neck (or spinal axis). These hooks or "hangers" or over the shoulder hook portions will slip over the portion of the trapezius muscles which extend from the neck and lower skull to the shoulders, and then converge on opposing diagonals to join in a buckle-operated junction in the region of the xiphoid process (or base of the sternum), just above the user's solar plexus. From the point at which the two hangers buckle, a pair of adjustable nylon straps will run down and back to anchoring points on either side of the lower frame and then to the lower left and right points of attachment 70, 72 via the lower left and right mooring straps such as the right lower mooring strap 68 shown in FIG. 3. A padded, adjustable waist-belt as shown in FIGS. 5, 6, 10 and 11 extend from the base of the pack and core to encircle the user's waist just above the hip bones. The padded belt is coupled to the SRC below the lower left SRC lower load support site, or left SRC lower load support site 70 an proceeds around the wearer's hips on both sides. In operation, the backpack system has been loaded with a 120 pound weight and adjusted to insure that the hook portion of the SRC is clear of the top of the wearer's shoulders, and with this configuration, the adjustable padded belt has been released, without the hook portion of the SRC descending to contact the wearer's shoulders. This demonstrates that the load is not supported by the belt. The load remains supported by the lower left and right straps 54, 56 as they pull on the lower left and lower right buckles 58, 60.

The design of the Backpack System will accomplish several all-important functions. It will relieve the shoulders of much of their traditional load and eliminate the "shearing" effect of conventional shoulder straps on the shoulder joints, while transferring the load toward the central vertebral axis where it can be better balanced and more easily be borne. The hook or hanger design will also redistribute the load so that more of it may be borne not by the back but by the chest; and this design will free the shoulders and arms of the user for other activities while carrying the pack. The molded hooks or hangers, or left and right over the shoulder hook portions of the SRC of the Backpack System will be fabricated in a tough and durable, lightweight material that combines rigidity, flexibility, with immunity to water and chemicals, and strength.

Likely materials for the core of such an application would include a variety of carbon-fiber composites, as well as graphite composites and Kevlar®. The hooks or hangers of the Backpack System would be complemented and cushioned with layers of polymeric foam, and the entire hanger system would be encased within a heavy-duty, protective synthetic fiber shell.

The remainder of the Backpack System core could be produced in the same composite material, or in a comparably strong, stiff, and lightweight polycarbonate polymer; and the frame, viewed from the side, displays an alignment that parallels the natural curvature of the human spine. The core will provide anchors and fasteners for attachment of the basic pack modules and accessories, and will also establish adequate channels for cooling ventilation between the user's back and the pack. And the bottom portion of the frame, which extends horizontally to the rear to form a cargo-carrier ledge, will also incorporate a fold-out, foam-cushioned seat that fastens to the core with two adjustable nylon straps, permitting the user to enjoy the support of the pack-core while sitting and resting, fishing or hunting.

The great advantage of the Backpack System, as should be clear from the foregoing description, is its superior and innovative semi-rigid core system. Tough and strong yet lightweight and superbly ventilated, the frame of the Backpack System—with its unique, molded hanger system, its integrated and reinforced modular design, and its easily customized, all-purpose versatility—would offer day-hikers, weekend backpackers, and seasoned backcountry trekkers and hunters a backpack option with superior performance over the short or long haul: and more comfort in the carrying than they would have thought possible. Clever in conception and exceptionally thoughtful in design, the Backpack System should clearly find a wide and enthusiastic reception in the outdoors-related markets of America and the world, as well as in the various branches of the United States Armed Forces. The Backpack System is cost-effective to produce in the embodiments, as shown in FIG. 1.

The embodiments of the invention described herein are exemplary and numerous modifications, variations and rearrangements can be readily envisioned to achieve substantially equivalent results, all of which are intended to be embraced within the spirit and scope of the invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

APPENDIX

Parts List and Reference Numbers

10 Back Pack System
12 covered semi-rigid core
14 cover
15*a* cover front panel
15*b* cover rear panel
16 field pack
18 zipper
20 left edge of pack
22 SRC Semi-Rigid Core
24 outer StyroFoam pad
26 inner StyroFoam pad
28 outer SRC panel
30 inner StyroFoam pad
32 inner SRC panel
34 left over shoulder hook portion
36 right over shoulder hook portion
38 back plane portion
40 left root portion
42 right root portion
44 center top edge portion of back plane
46
48
50
54 left lower strap
56 right lower strap
58 left lower buckle
60 right lower buckle
62 left mooring strap
64 right mooring strap
66 right lower buckle mooring slot
68 right lower buckle mooring strap

70 left SRC lower load support site
72 right SRC lower load support site
74 left upper load support site
76 right upper load support site
78 two part quick snap coupling
80 left loop coupling strap
82 left loop coupling slot
84
86 right loop slot
88 right loop coupling strap
90 right loop slot
92 left shoulder shackle
94 right shoulder shackle
96

What is claimed is:

1. A backpack system for use in combination with a wearer comprising:

an SRC (a non-compressible semi-rigid core) of homogenous material molded to form a back plane portion, the back plane portion having a left SRC lower load support site, a right SRC lower load support site, the SRC, extending upward from the backplane on the wearer to a bifurcation at the back of and free of the wearer's neck, the SRC then extending to form a left over the left shoulder hook portion and a right over the right shoulder hook portion, the left and right hook portions each extending over the wearer's shoulder and then downward over, and past, the wearer's chest to a left and right hook portions distal end to form a left upper load support site and a right upper load support site, a cross link coupling, that couples the left and right upper load support sites, a left lower strap coupling the left SRC lower load support site to the cross link coupling, and a right lower strap coupling the right SRC lower load support site to the cross link coupling, the cross-link coupling being positioned against the wearer's solar plexus, the SRC back plane having a forward surface and the cross link coupling having a back surface, the wearer's body spacing the back plane forward surface and the cross link coupling rear surface apart while driving the lower left and right straps into tension, the tension in the left and right lower straps respectively being adjusted in length to provide a left and right vertical component of force to the lower left and right support sites, the SRC being formed to have a back plane length sufficient to position the SRC left and right hook portions above the wearer's shoulders, the left SRC lower load support site has an adjustable buckle characterized to receive the lower left strap bottom end, the right SRC lower load support site has an adjustable buckle characterized to receive the lower right strap bottom end, a cross link coupling is formed by permanently fixing one half (male or female) of a quick release buckle to the SRC left hook portion distal end, and permanently fixing the alternate half (female or male) of the quick release buckle to the SRC right hook portion distal end, the SRC left hook portion distal end is then coupled to the SRC right hook portion distal end by engaging the permanently fixed male and female ends of the quick release buckle.

2. The backpack system of claim 1 wherein the fixed length cross link coupling is made adjustable in length by using an adjustable strap loop to attach the male or the female half of the quick release end of the buckle to the SRC left or right hook portion distal end.

3. The backpack system of claim 1 further comprising:

a belt coupled to the SRC below the left SRC lower load support site, and below the right SRC lower load support site, the belt means being adjustable and characterized to stop lateral movement of the SRC at the left and right SRC lower load support sites.

4. The backpack system of claim 3 wherein the belt passes though slots in the SRC lower than the left and right SRC lower load support sites, the belt having an adjustment range and when tightened, it holds the lower portion of the SRC against the wearer's lower back and stabilizes the SRC against lateral motion.

5. A backpack system for use in combination with a wearer comprising:

an SRC (a non-compressible semi-rigid core) of homogenous material molded to form a back plane portion having a left SRC lower load support site and a right SRC lower load support site, the SRC worn by a wearer, extending upward on the back of the wearer to a bifurcation at the back of and free of the wearer's neck, the SRC then extending to form a left over the left shoulder hook portion and a right over the right shoulder hook portion, the left and right hook portions each extending over the wearer's respective left and right shoulder and then downward over, and past, the wearer's chest to a left and right hook portions distal end to form respectively, a left upper load support site and a right upper load support site, the SRC is formed to have a back plane length that positions the left hook portions and the right hook portions above the surface of the wearer's left and right shoulders with a loaded field pack attached to a top region of an outer SRC panel cover containing the SRC, the SRC has a front surface adjacent to the wearer's back and a rear surface facing away from the wearer's back, a cover, the cover having a thin padding layer is positioned on the front and back of the SRC, and a fabric outer layer is positioned on the front and back of the SRC, the fabric layer encloses and protecting the padding layers, a cross link coupling couples the left upper load support site to the right upper load support site, the cross link coupling has a left and a right end, the cross link coupling left end is coupled to the left upper load support site and the cross link coupling right end is coupled to the right upper load support site, a lower left strap coupling the left SRC lower load support site to the cross link coupling, and a lower right strap coupling the right SRC lower load support site to the cross link coupling, the SRC back plane having a forward surface and the cross link coupling having a back surface, the wearer's body positioned between the SRC forward surface and the cross link coupling rear surface forcing the back plane forward surface and the cross link coupling rear surface apart while driving the lower left and right straps into tension, the lower left strap has a top end permanently fixed to the left upper load support site, and a bottom end, the left SRC lower load support site has an adjustable buckle characterized to receive the lower left strap bottom end, the lower right strap coupling the right SRC lower load support site to the cross link coupling has a top end permanently fixed to the right upper load support site, and a bottom end, right SRC lower load support site has an adjustable buckle characterized to receive the lower right strap bottom end, an adjustable length cross link coupling is formed by fixing one half (male or female) of a quick release buckle to the left upper load support site, and fixing the alternate half (female or male) of the quick release buckle to the right upper load support site, the left upper load support site is then coupled to the right upper load support site by engaging the male and female ends of the quick release buckle.

6. The backpack system of claim 5 wherein the cross link coupling is made adjustable in length by using an adjustable strap loop to attach the male or the female half of the quick release end of the buckle to left or right upper load support site.

7. The backpack system of claim 5 further comprising:

a belt means coupled to the SRC below the left lower load support site, and below the lower right lower load support site, the belt means being adjustable and characterized to stop lateral movement of the SRC at the left and right lower load support sites.

8. The backpack system of claim 7 wherein the belt means passes though slots in the SRC lower than the left and right lower load support sites, the belt means having an adjustment range characterized to hold the lower portion of the SRC against the wearer's lower back and stabilizes the SRC against lateral motion.

9. A backpack suspension apparatus for use in combination with a wearer comprising:

a covered semi-rigid homogeneous non-compressible SRC core assembly within a padded cover to form a covered SRC back plane having, a covered left over shoulder hook portion and a covered right over shoulder hook portion, each respective left and right over shoulder portion being initially spaced apart and extending from respective left and right root portions of the top edge of the covered back plan in parallel relation to a respective distal end to form an SRC left and a right upper load support site, the covered back plane having respective left and right SRC lower load support sites, a quick snap coupling having a left end and a right end, for joining the left and right upper load support sites of the left and right over shoulder portions, a left lower support strap for connecting the left lower support site to the distal ends of the left over shoulder portions, and a right lower support strap for connecting the right lower support site to the distal ends of the right over shoulder portions of the covered semi-rigid core assembly, covered back plane.

10. The backpack system of claim 9 wherein the covered semi-rigid homogeneous non-compressible SRC core assembly within a padded cover assembly is further characterized as having an SRC (a non-compressible semi-rigid core) of homogenous material molded to form the back plane portion having a lower left point of attachment and a lower right point of attachment, the SRC worn by a wearer, extending upward on the wearer to a bifurcation at the back of and free of the wearer's neck, the SRC then extending to form a left over the left shoulder hook portion and a right over the right shoulder hook portion, the left and right hook portions each extending over the wearer's shoulder and then downward over, and past, the wearer's chest to a left and right upper load support sites.

11. The backpack system of claim 10 wherein the covered semi-rigid core (SRC) assembly is further characterized as being an SRC formed from a material selected from a group comprising:

a. ABS plastic;

b. Aluminum;

c. Carbon Fiber;

d. Laminated hollow core;

e. Kevlar.

* * * * *